United States Patent [19]

Huppert et al.

[11] Patent Number: 4,991,361

[45] Date of Patent: Feb. 12, 1991

[54] CYLINDER HONE

[75] Inventors: James C. Huppert; Jack A. Zitzer, both of St. Paul, Minn.

[73] Assignee: Minnesota Mining and Manufacturing Company, Saint Paul, Minn.

[21] Appl. No.: 438,520

[22] Filed: Nov. 16, 1989

[51] Int. Cl.[5] ..... B24B 9/02; B24D 17/00

[52] U.S. Cl. ..... 51/346; 51/331; 51/361; 51/34 H

[58] Field of Search ..... 51/330, 331, 338, 346, 51/347, 352, 353, 335, 336, 337, 338, 359, 360, 361, 372, 403, 34 H, 34 J, 34 K, 345

[56] References Cited

U.S. PATENT DOCUMENTS

| | | | |
|---|---|---|---|
| 1,910,658 | 5/1933 | Tydeman | 51/339 |
| 2,135,884 | 11/1938 | Disco | 51/372 X |
| 2,174,945 | 10/1939 | Palotce | 51/194 |
| 2,198,047 | 4/1940 | Wick | 51/335 |
| 2,259,685 | 10/1941 | Elsloo | 51/194 |
| 2,366,158 | 1/1945 | Steenbock et al. | 51/194 |
| 2,403,409 | 7/1946 | Strahm | 51/194 |
| 2,725,693 | 12/1955 | Smith | 51/403 |
| 2,791,871 | 5/1957 | Johnson | 51/346 |
| 4,051,637 | 10/1977 | Takeishi | 51/364 |

OTHER PUBLICATIONS

The Inside Story, Straight From Scot, Scot Industrial, Inc. Stock List #586, Scot Industries, Inc., P.O. Box 248, Muscoda, Wisconsin 53573.

*Primary Examiner*—Robert A. Rose
*Assistant Examiner*—Bruce P. Watson
*Attorney, Agent, or Firm*—Donald M. Sell; Walter N. Kirn; William L. Huebsch

[57] ABSTRACT

A cylinder truing hone comprising a plurality of pressure members mounted in circumferentially spaced locations around a driven member for movement radially of the driven member and with pressure surfaces on the pressure members outermost. An axially movable cam on the driven member is in engagement with the pressure members and can move them outwardly. Abrasive coated sheet material extends over the pressure surfaces where it can be pressed into engagement with a cylindrical inner surface by movement of the cam, and a mechanism is provided for changing the portion of the abrasive coated sheet material extending over the pressure surfaces.

4 Claims, 3 Drawing Sheets

CYLINDER HONE

TECHNICAL FIELD

The present invention relates to hones for use in truing the inside cylindrical surface of a tube.

BACKGROUND ART

Hones are commonly used for truing the inside cylindrical surface of a tube, such as a seamless tube intended for use as a hydraulic cylinder to remove defects called "long radius curvature (camber) and spiral wave" (see page 3 of the booklet entitled "The Inside Story Straight From Scot" available from Scot Industries, Inc., P.O. Box 248, Muscoda, Wisconsin 53573, the content whereof is incorporated herein by reference).

Typically such hones comprise a driven member having an axis and an end portion adapted to be engaged to axially move the driven member while rotating the driven member around its axis; a plurality of abrasive stones having elongate grinding surfaces mounted on the driven member for movement radially of the driven member with the pressure surfaces aligned axially of the driven member, facing radially outwardly of the driven member, and spaced circumferentially around the driven member; and means for biasing the grinding stones radially outwardly on the driven member. The hones are rotated about their axes while being moved axially through the tube so that the pressure of the biasing means causes the abrasive stones to abrade and true the inner surface of the tube. While such hones are effective, the stones have a tendency to crack or chip, and thus a significant amount of maintenance is required to change the stones on such hones.

DISCLOSURE OF INVENTION

The present invention provides a hone that is an effective as a hone using abrasive stones for truing the inside cylindrical surface of a tube, while utilizing abrasive coated sheet material which does not crack or chip and is more easily changed than abrasive stones.

According to the present invention there is provided a hone adapted for use in truing the inside cylindrical surface of a tube, which hone comprises a driven member having an axis and an end portion adapted to be engaged to axially move the driven member while rotating the driven member around its axis; a plurality of pressure members having elongate pressure surfaces; means mounting the pressure members on the driven member for movement radially of the driven member with their pressure surfaces aligned axially of the driven member, facing radially outwardly of the driven member, and spaced circumferentially around the driven member; cam means including a cam mounted for movement on the driven member between release and pressure positions and in engagement with the pressure members for moving the pressure members radially outwardly of the driven member upon movement of the cam from its release position toward its pressure position; a separate supply of abrasive coated sheet material adjacent each of the pressure members, the abrasive coated sheet material having a portion extending over the pressure surface of the adjacent pressure member; and means for changing the portion of the abrasive coated sheet material extending over each of the pressure surfaces.

The separate supply of abrasive coated sheet material for each of the pressure members is preferably tightly helically wrapped into a spool having a through axially extending opening and a coating of adhesive on each of its end surface adapted to hold the abrasive sheet material in a tightly wound condition in the spool and to be broken along the outermost wrap by force applied to the outermost wrap of abrasive sheet material to unwrap it from the spool. For each of the pressure members the driven member can have a support rod on one side adapted to support the spool with the support rod extending through the opening the spool, and the hone can include a rotatable take up spindle on the opposite side of the support member adapted to engage an end portion of the supply of abrasive coated sheet material extending from the spool to the take up spindle across the support surface of the pressure member. also, the means for changing the portion of the abrasive coated sheet material extending over each of the pressure surfaces can comprises means for rotating the take up spindles to wind the abrasive coated sheet material from the spools onto them, which means as described herein includes spur gears fixed on the take up spindles, a ring gear rotatably mounted on the driven member and in engagement with the spur gears, means for rotating the ring gear and thereby the take up spindles, and locking means for releasably locking the take up spindles in a predetermined position. Thus, to change all of the portions of the abrasive coated sheet material along the pressure surfaces to be brought into engagement with the tube an operator of the hone need only release the locking means, rotate the take up spindles, and then again engage the locking means.

BRIEF DESCRIPTION OF DRAWING

The present invention will be further described with reference to the accompanying drawing wherein like reference numerals refer to like parts in the several views, and wherein.

DETAILED DESCRIPTION

Figure 1:
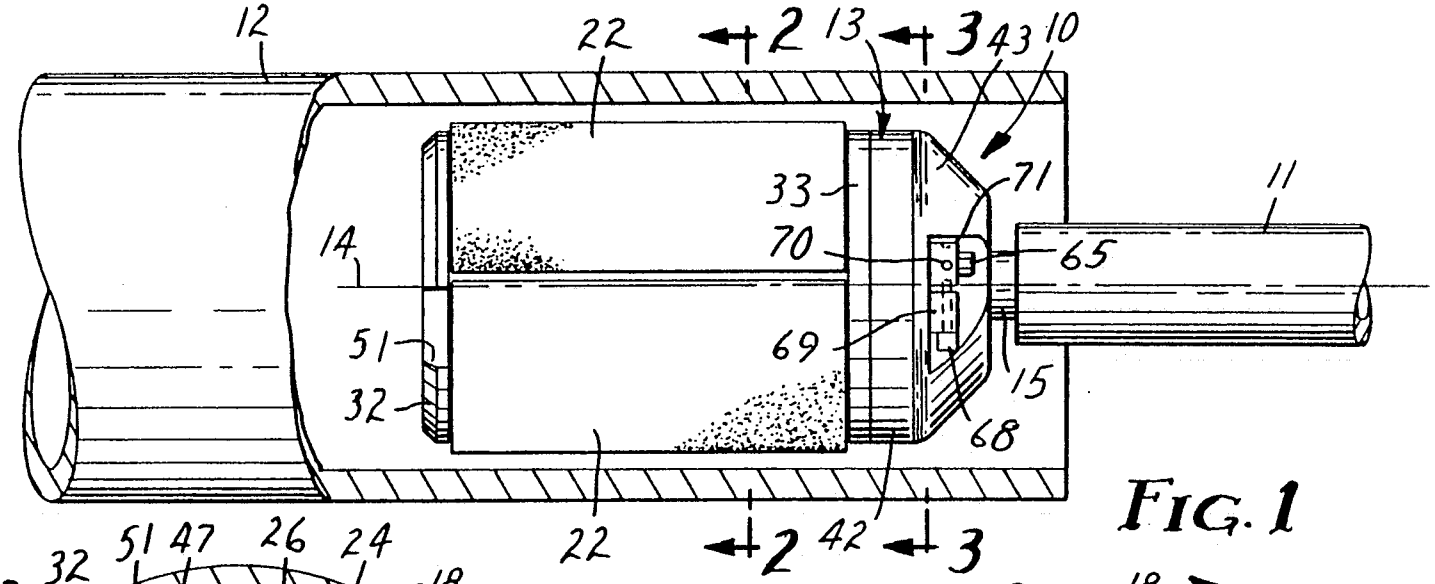
FIG. 1 is a side view of a hone according to the present invention illustrated in use to true the inside cylindrical surface of a fragment of a tube and being driven by a fragment of a drive member.

Referring now to the drawing, there is shown a hone 10 according to the present invention illustrated being driven by a drive member 11 to true the inside cylindrical surface of a tube 12.

Generally the hone 10 comprises a driven member 13 having an axis 14 and an end portion 15 having external threading and elongate slots adapted to be engaged by the drive member 11 to move the driven member 13 axially while rotating the driven member 13 around its axis 14; a plurality of pressure members 17 having elongate pressure surfaces 18; means mounting the pressure members 17 on the driven member 13 for movement radially of the driven member 13 with the pressure surfaces 18 aligned axially of the driven member 13, facing radially outwardly of the driven member 13, and spaced circumferentially around the driven member 13; cam means including a cam 20 mounted for movement on the driven member 13 between release and pressure positions and in engagement with the pressure members 17 for moving the pressure members 17 radially outwardly of the driven member 13 upon movement of the cam 20 from its release postion toward its pressure position; a separate supply of abrasive coated sheet material 22 (i.e., having abrasive granules on one surface) adjacent each of the pressure members 17, the abrasive coated sheet material 22 having a portion extending over the pressure surface 18 of the adjacent pressure member 17; and means for changing the portion of the abrasive coated sheet material 22 extending over each of the pressure surfaces 18.

The pressure members 17 each include an elongate rectangular plate like portion 24 having the pressure surface 18 along one edge, and a plurality of cylindrical projections 26 having semi spherical distal ends extending generally at right angles with respect to the pressure surface 18 from the edge of the plate like portion 24 opposite the pressure surface 18. The driven member 13 includes a central guide structure 28 having a central bore 27 coaxial with the axis 14 of the driven member 13, three axially and radially extending guide portions each having surfaces defining an axially extending slot 29 opening through its distal end for closely receiving and guiding the plate like portion 24 of one of the pressure members 17, and defining a plurality of radially extending cylindrical bores or passageways 31 communicating between the slot and the bore 27 and receiveing the projections 26 to afford and help guide movement of one of the pressure members 17 radially of the driven member 13 with its pressure surface 18 facing radially outwardly of the driven member 13 and its projections 26 projecting through the passageways slots 31 toward the axis 14 of the driven member 13 and into the bore 27. End plates 32 and 33 are bolted at the opposite ends of the guide structure 28, define opposite ends of the slots 29, and fixedly support pins 34 projecting into grooves along the ends of the plate like portions 24 to limit their movement radially of the guide structure 28.

Figure 4:
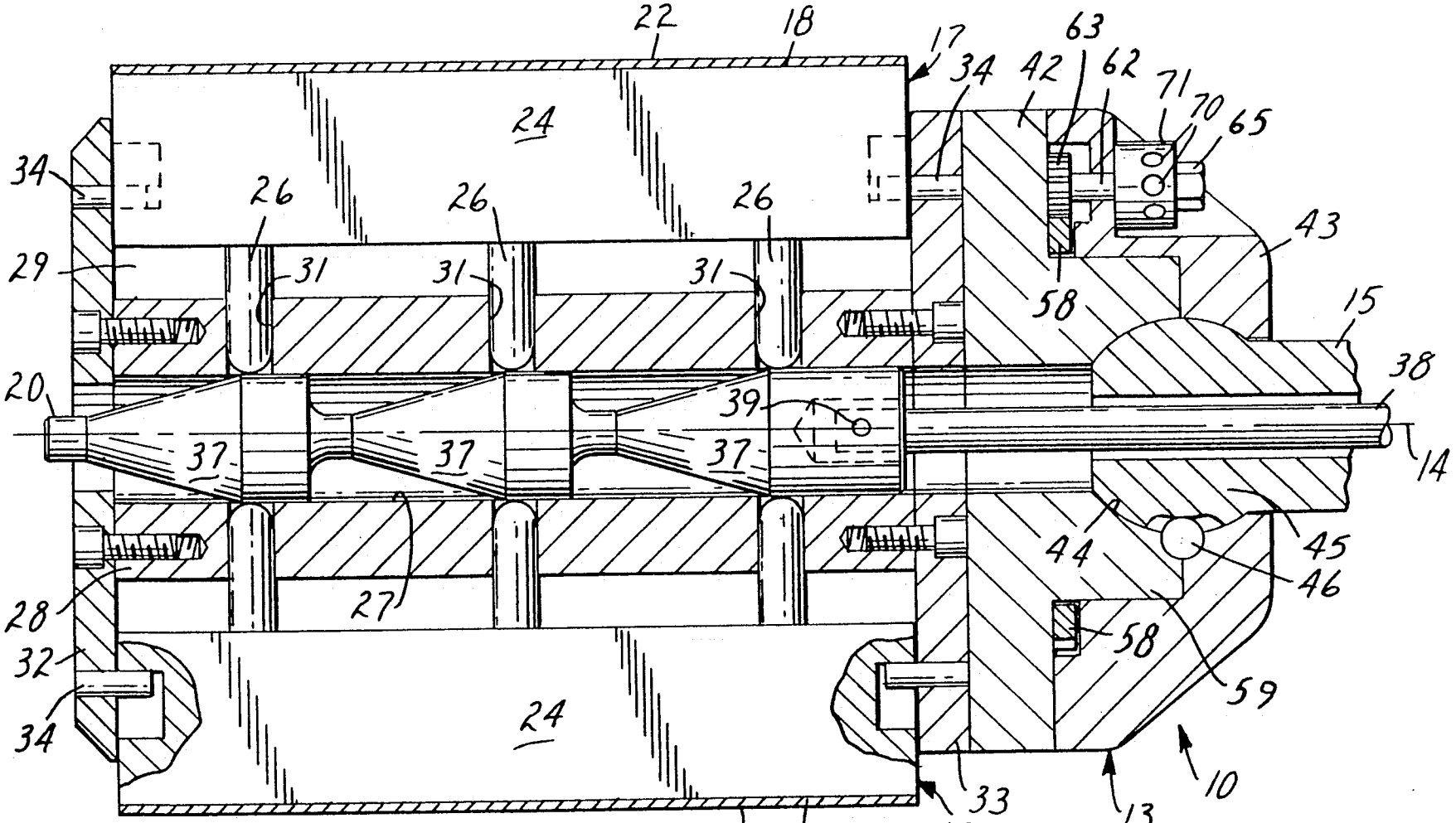
FIG. 4 is an enlarged sectional view taken approximately along line 4—4 of FIG. 3 with the hone removed from the tube.
Figures 5, 6:
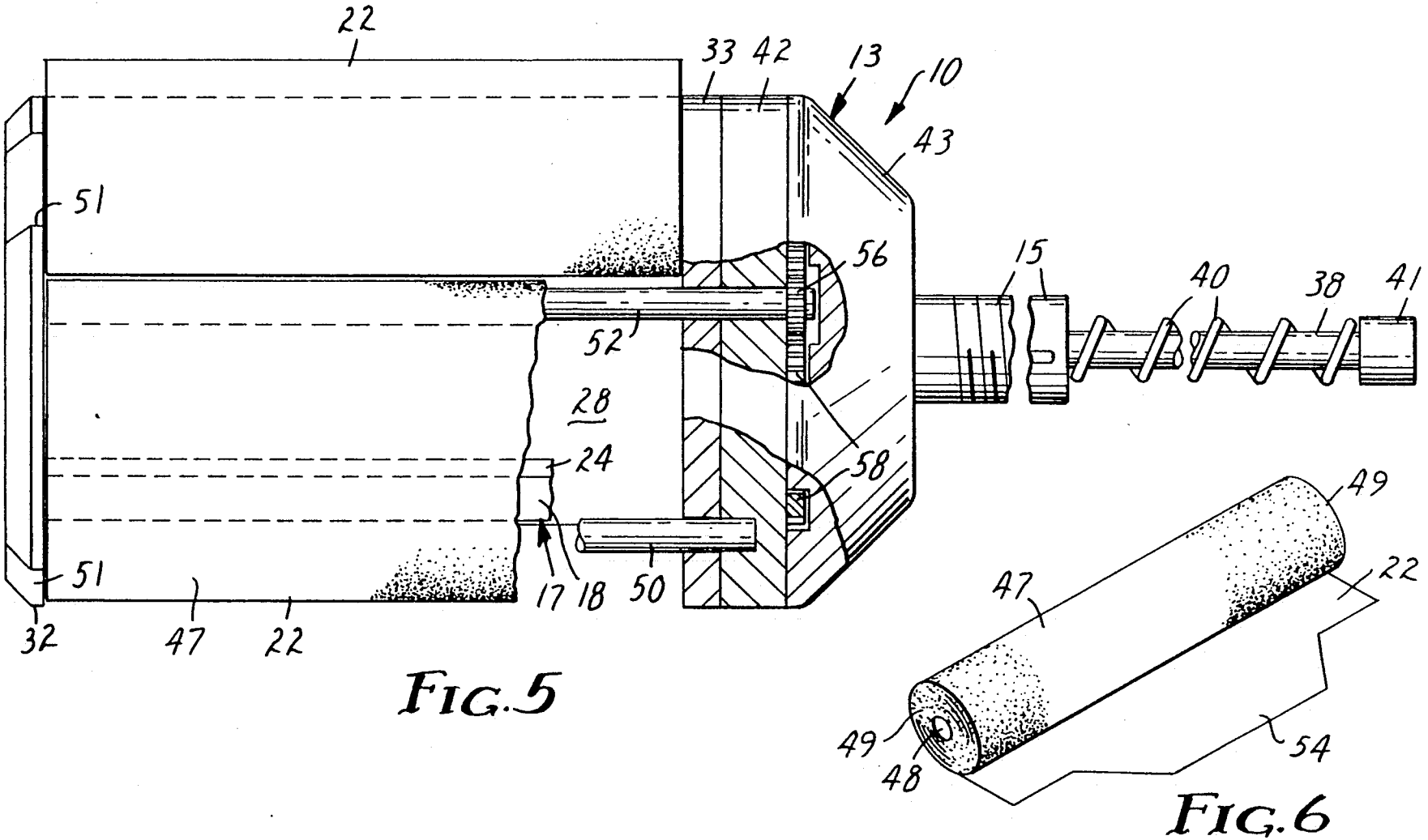
FIG. 5 is an fragmentary enlarged side view of the hone of FIG. 1 having parts broken away to show detail.
FIG. 6 is a perspective view of a spool of abrasive coated sheet material used in the hone of FIG. 1.

The cam means comprises the cam 20 that is positioned in the bore 27 for movement axially of the driven member 13 between the release and pressure positions. The cam (FIG. 4) comprises cam portions 37 having cam surfaces contacted by the projections 26 of the pressure members 17 and having frustoconical shapes oriented to move the pressure members 17 radially outwardly of the driven member 13 upon movement of the cam 20 from its release position toward its pressure position in response to a force applied to the cam 20 through a rod 38 having an end portion projecting into a socket in an end portion of the cam 20 and pivotably attached to the cam 20 by a pin 39, and an opposite end projecting through a central opening in the end portion 15, which force is typically provided hydraulically by a device including the drive member 11 that drives the hone 10. The hone 10 further includes means in the form of a coil spring 40 (FIG. 5) around the rod 38 and compressed between a knob 41 fixed on the end of the rod 38 and the end portion 15 for biasing the cam 20 toward its release position so that upon release of a force biasing the cam 20 toward its pressure position the cam 20 will return to its release position allowing the pressure members 17 to be moved radially inwardly on the driven member 13.

The end portion 15 is pivotably attached to the end plate 33 by a journal plate 42 bolted to the side of the end plate 33 opposite the guide structure 28 and a cap plate 43 bolted to the side of the journal plate 42 opposite the end plate 33, which journal and cap plates 42 and 43 define a socket 44 (FIG. 4) therebetween that closely receives a spherical end part 45 of the end portion 15 while affording pivotal movement of that spherical end part 45 within the socket 44 (limited by a groove along the end part 45 into which a fixed ball 46 projects) to facilitate slight misalignment between a device during the hone 10 and the inner surface of the tube 12 being honed.

Figure 2:
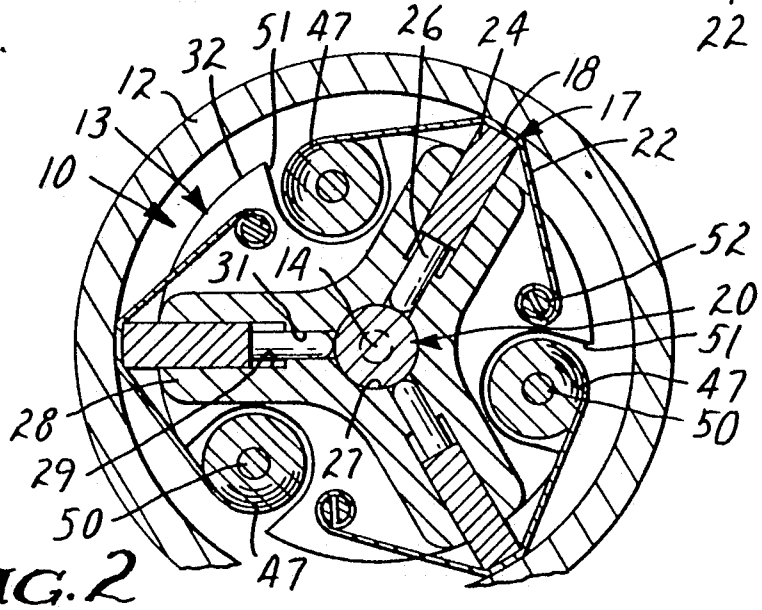
FIG. 2 is a sectional view taken approximately along line 2—2 of FIG. 1.

The separate supply or length of abrasive coated sheet material 22 for each of the pressure members 17 is tightly helically wrapped into a spool 47 having a through axially extending opening 48 and a coating 49 of adhesive on each of its opposite end surfaces. The coating 49 of adhesive are adapted to hold the length of abrasive sheet material 22 in a tightly wound condition in the spool 47 and to be broken along the outermost wrap of the abrasive coated sheet material 22 by force applied to that outermost wrap to unwrap the abrasive coated sheet material 22 from the spool 47. For each of the pressure members 17 the driven member 11 has a support rod 50 on one side fixed at one end in the end plate 33 and projecting parallel to the axis of the hone 10 to support the spool 47 with the support rod 50 extending through its central opening 48, and with the spools 47 being movable onto the support rods 50 through U-shaped openings 51 in the end plate 32 (FIG. 2). For each of the pressure members 17 the hone 10 also includes a take up spindle 52 on the side of the pressure member 17 opposite the support rod 50. The take up spindle 52 has an end portion journaled in the journal plate 42 for rotation about its axis, and has a through slot adapted to receive a reduced width end portion 54 (FIG. 6) of the supply of abrasive coated sheet material 22 extending from the spool 47 to the take up spindle 52 across the pressure surface 18 of the pressure member 17.

Figure 3:
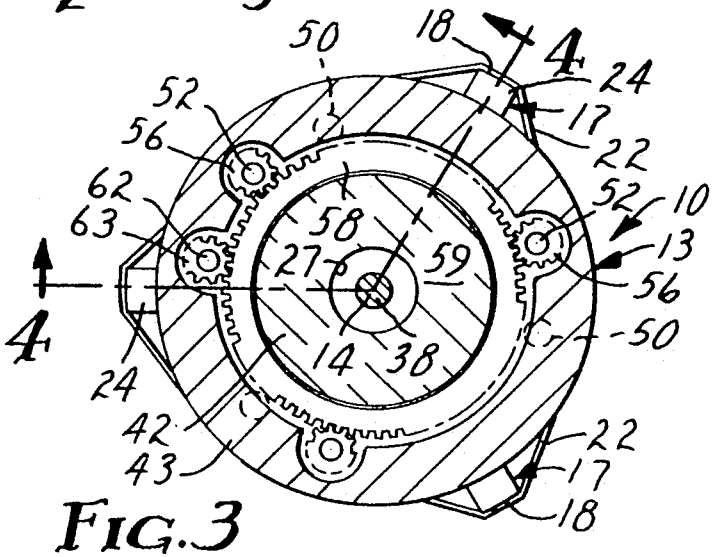
FIG. 3 is a sectional view taken approximately along line 3—3 of FIG. 1 with the hone removed from the tube.

As a preferred example, the lengths of abrasive coated sheet material 22 in the spools 47 can be about 11.5 inches wide, 29 inches long lengths of the coated abrasive sheet material commercially designated "Regal Resin Bond Cloth, YN Weight, Grade 36 abrasive" that is commercially avaiable from Minnesota Mining and Manufacturing Company, St. Paul, Minn., tightly wound to have a central opening 48 9/16 inch in diameter, and having a coating 49 of the hot melt adhesive commercially designated "JET MELT" 3762 hot melt adhesive also available from Minnesota Mining and Manufacturing Company on each of its end surfaces The means for changing the portion of the abrasive coated sheet material 22 extending over each of the pressure surfaces 18 comprises means for rotating the take up spindles 52 to wind the abrasive coated sheet material 22 onto the take up spindles 52 including spur gears 56 (FIG. 3) fixed on adjacent end portions of each of the take up spindles 52 and located in a cavity between the journal plate 42 and the cap plate 43, and a ring gear 58 rotatably mounted around a cylindrical projecting portion 59 of the journal plate 42 adjacent the cap plate 43 and having teeth in engagement with the teeth of the spur gears 56. A drive assembly including a shaft 62 rotatably mounted in the journal plate 42, a spur gear 63 fixed to the shaft 62 and having teeth in engagement with the teeth of the ring gear 58 and a hexagonal drive portion 65 (FIG. 1) accessible along the outer surface of the cap plate 43 that is adapted for engagement by a tool such as a wrench to rotate the drive assembly and through the spur gear 63, ring gear 58 and the spur gears 56, the three take up spindles 52 to simultaneously wind the three lengths of abrasive material 22 onto them.

Means in the form of a pin 68 axially slidable in a bearing block 69 and spring biased toward an engaged position with an end portion of the pin 68 in one of several sockets 70 around the periphery of a collar 71 fixed to the shaft 62 of the drive assembly, which pin 68 has a portion adapted for manual engagemnt afford manually sliding it against the bias of the spring out of engagement with one of those sockets 70 is provided for releasably locking the three take up spindles 52 in a predetermined position. The lengths of abrasive coated sheet material 22 can then be changed between uses of the hone 10 by pulling and holding the pin 68 out of the sockets 70 while a tool such a wrench is applied to the drive portion 65 to rotate it and thereby wind the lengths of abrasive coated sheet material 22 from the spools 47 onto the take up spindles 52 to change the portion of the lengths of abrasive coated sheet material 22 on the pressure surfaces 18, whereupon the pin 68 is allowed to enter an adjacent socket 70 to thereby again lock the three take up spindles 52 in their new position.

The present invention has now been described with reference to one embodiment thereof. It will be apparent to those skilled in the art that many changes can be made in this embodiment descrlibed without departing from the scope of the present invention. Thus the scope of the present invention should not be limited to the structure described in this application, but only by structures described by the language of the claims and the equivalents of those structures.

We claim:

1. A hone adapted for use in truing the inside cylindrical surface of a tube that is longer than the hone, said hone comprising:

a driven member having an axis and an end portion adapted to be engaged to axially move said driven member while rotating said driven member around said axis;

a plurality of pressure members having elongate pressure surfaces;

means mounting said pressure members on said driven member for movememt radially of said driven member with said pressure surface aligned axially of said driven member, facing radially outwardly of said driven member, and spaced circumferentially around said driven member;

cam means adapted to be operated through the driven end portion of the driven member and including a cam mounted for movement on said driven member between release and pressure positions and in engagement with said pressure members for moving said pressure members radially outwardly of said driven member upon movement of said cam from said release position toward said pressure position;

a separate supply of abrasive coated sheet material adjacent each of said pressure members, said abrasive coated sheet material having a portion extending over the pressure surface of the adjacent pressure member; and means only operable between uses of the hone to true the inside cylindrical surface of a tube for changing the portion of the abrasive coated sheet material extending over each of said pressure surfaces.

2. A hone according to claim 1 wherein for each one of said pressure members:

said supply of abrasive coated sheet material is tightly helically wrapped into a spool having a through axially extending opening and opposite end surfaces, and a coating of adhesive on each end surface adapted to hold said sheet material in a tightly wound condition in the spool and to be broken along the outermost wrap by force applied to the outermost wrap of abrasive material to unwrap the outermost wrap from the spool;

said driven member has a support rod on one side of the pressure member supporting said spool with the support rod extending through the opening in the spool;

said hone includes a take up spindle adapted to engage an end portion of said supply of abrasive coated sheet material, said take up spindle has an axis parallel with the axis of said driven member and is mounted on said driven member at the side of the pressure member opposite said support rod for rotation about its axis to wind on abrasive coated sheet material extending from the spool across the pressure surface of the pressure member; and said means for changing the portion of the abrasive coated sheet material extending over each of said pressure surfaces comprises means for rotating said take up spindles to wind said abrasive coated sheet material onto said take up spindles.

3. A hone according to claim 2 wherein:

said means for rotating said take up spindles to wind said abrasive coated sheet material onto said take up spindles includes spur gears having teeth, said spur gears being fixed on adjacent ends of each of said take up spindles;

a ring gear rotatably mounted on said driven member and having teeth in engagement with the teeth of said spur gears;

means for rotating said ring gear to rotate said take up spindles by rotation of said spur gears; and means for releasably locking said take up spindles in a predetermined position.

4. A hone according to claim 1 wherein said pressure members each include an elongate plate like portion having said pressure surface along one edge, and a plurality of projections extending generally at right angles with respect to said pressure surface from the edge of said plate like portion opposite said pressure surface, said driven member has a coaxial bore and has a plurality of radially extending slots communicating with said bore and receiving said projections to afford movement of said pressure members radially of said driven member with said pressure surfaces facing radially outwardly of said driven member and said projections projecting toward the axis of said driven member and into said bore, said cam means comprises a cam member positioned in said bore for movement axially of said driven member between said release and pressure positions, said cam member comprising cam portions having cam surfaces contacted by said projections of said pressure members and shaped to move said pressure members radially outwardly of said driven member upon movement of said cam member from said release position toward said pressure position; and said hone further includes means for biasing said cam member toward said release position.

* * * * *